US006452569B1

(12) United States Patent
Park et al.

(10) Patent No.: US 6,452,569 B1
(45) Date of Patent: Sep. 17, 2002

(54) ANTENNA, AND MANUFACTURING METHOD THEREFOR

(75) Inventors: Heung-Soo Park; Jae-Suk Sung, both of Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/867,689

(22) Filed: May 31, 2001

(30) Foreign Application Priority Data

Mar. 29, 2001 (KR) ..... 2001-16656

(51) Int. Cl.[7] ..... H01Q 1/36
(52) U.S. Cl. ..... 343/895; 29/600
(58) Field of Search ..... 343/872, 873, 343/895; 29/600

(56) References Cited

U.S. PATENT DOCUMENTS

| | | | | |
|---|---|---|---|---|
| 2,611,868 A | * | 9/1952 | Marston et al. | 343/895 |
| 4,772,895 A | * | 9/1988 | Garay et al. | 343/895 |
| 5,359,340 A | * | 10/1994 | Yokota | 343/792 |
| 5,995,065 A | | 11/1999 | Kitchener et al. | 343/895 |
| 6,016,130 A | * | 1/2000 | Annamaa | 343/895 |
| 6,137,452 A | | 10/2000 | Sullivan | 343/873 |

FOREIGN PATENT DOCUMENTS

| | | |
|---|---|---|
| EP | 0 831 549 A1 | 3/1998 |
| EP | 0 986 132 A2 | 3/2000 |
| GB | 9221536.7 | 10/1992 |
| GB | 2 271 670 A | 4/1994 |
| GB | 2 344 938 A | 6/2000 |
| JP | 09-144557 | 5/1997 |
| WO | WO 97/04496 | 2/1997 |
| WO | WO 97/18601 | 5/1997 |

OTHER PUBLICATIONS

Patent Abstracts of Japan: Publication No.: 10–322122, Apr. 12, 1998. "Dual–Band Antenna" //C:¥H10–322122 ¥patent–file¥H10–322122–PAJ.htm.

* cited by examiner

*Primary Examiner*—Tan Ho
(74) *Attorney, Agent, or Firm*—Lowe Hauptman Gilman & Berner, LLP

(57) ABSTRACT

An antenna and a manufacturing method therefor are disclosed, in which the sensitivity characteristic of the dual band antenna utilizing a plurality of frequency bands is improved, and at the same time, the antenna can be miniaturized. A first cylindrical body 110 around which a primary coil 100 is spirally wound is inserted into a second cylindrical body 220 around which a secondary coil is wound. A projected portion of the primary coil 100 is electrically connected to the secondary coil 200, thereby forming a dual band antenna 300.

24 Claims, 10 Drawing Sheets

ANTENNA, AND MANUFACTURING METHOD THEREFOR

FIELD OF THE INVENTION

The present invention relates to an antenna and a manufacturing method therefor. Particularly, the present invention relates to an antenna and a manufacturing method therefor, in which the sensitivity characteristic of the dual band antenna utilizing a plurality of frequency bands is improved, and at the same time, the antenna can be miniaturized.

BACKGROUND OF THE INVENTION

The generally known CDMA mobile communication terminal having a plurality of frequency bands is capable of transmitting and receiving voices and motion pictures. The dual mode antenna which is used in such a CDMA terminal has to be capable receiving signals through a plurality of frequency bands.

In this dual band antenna, a contacting-separating type antenna and a vertical antenna are coupled together, or a linear monopole antenna and a vertical antenna are coupled together. Or primary and secondary antennas are coupled together in a serial or parallel form.

One of this conventional vertical dual band antennas is disclosed in Japanese Patent Application Laid-open No. Hei-10-322122.

This dual band antenna is constituted a shown in FIG. 1. That is, there is formed a primary coil 10 which has a certain length and pitches. Further, a secondary coil 30 which has a length and pitches larger that those of the primary coil 10 is vertically connected to the lower end of the primary coil 10, thereby forming a dual band antenna 40.

In this antenna 40, a frequency band is provided over the entire primary and secondary coils 10 and 30, while another frequency band is provided in the secondary coil 30 which has a length and pitches larger than those of the primary coil 10.

In this antenna 40, however, the primary coil 10 and the secondary coil 30 are connected in the vertical direction, and therefore, the overall length of the antenna is extended, with the result that the miniaturization of the mobile communication terminal becomes difficult.

Meanwhile, in an attempt to overcome the above described disadvantages, recently the antenna is installed within the terminal, and when the terminal is used, the antenna is drawn out. In this method, however, an antenna accommodating space has to be provided within the terminal, and therefore, the mobile communication terminal cannot be miniaturized.

SUMMARY OF THE INVENTION

The present invention is intended to overcome the above described disadvantages of the conventional techniques.

Therefore it is an object of the present invention to provide an antenna in which the dual band antenna capable of receiving signals through a plurality of frequency bands is improved in its sensitivity characteristic, and the antenna can be miniaturized.

It is another object of the present invention to provide a manufacturing method for an antenna, in which the desired dielectric constant can be obtained by arbitrarily selecting the dielectric material so as to minimize the designing limitation, and the conductive line of the antenna can be constituted in an accurate manner so as to minimize the generation of defects during the manufacture.

In achieving the above objects, the antenna according to the present invention includes: a spiral primary coil; and a spiral secondary coil connected to one end of the primary coil, disposed outside the primary coil, and having pitches larger than those of the primary coil, whereby a frequency band is provided over the entire primary and secondary coils, and another frequency band is provided in the secondary coil.

In another aspect of the present invention, the method for manufacturing an antenna according to the present invention includes the steps of: forming a first cylindrical body; forming a first securing spiral channel around the first cylindrical body starting from an end of the first body to a certain part of the first body and having a predetermined length and pitches; installing a primary coil through the first securing spiral channel; forming a second cylindrical body having an inside diameter same as or larger than an outside diameter of the cylindrical first body, so as to receive the first cylindrical body; forming a second securing spiral channel around the second cylindrical body starting from an end of the second cylindrical body to a certain part of the second cylindrical body and having a predetermined length and pitches; installing a secondary coil through the second securing spiral channel; and inserting the first cylindrical body into the second cylindrical body, and contacting a portion of the exposed secondary coil of the second cylindrical body to a portion of the exposed primary coil of the first cylindrical body.

In still another aspect of the present invention, the method for manufacturing an antenna according to the present invention includes the steps of: i) preparing inner and outer ceramic substrates; ii) forming a via hole in each of the inner and outer ceramic substrates, and filling a conductive paste in the via hole; iii) forming a primary coil pattern on a surface of the inner ceramic substrate by using an antenna pattern forming means; iv) forming a secondary coil pattern on a surface of each of the outer ceramic substrates by using an antenna pattern forming means; v) bonding the inner and outer substrates together with the inner substrate having the primary coil disposed between upper and lower sheets of the outer substrates having the secondary coils, so as to make the primary and secondary coils connected together in a spiral form through the via holes of the inner and outer substrates; and vi) cutting the substrates thus bonded together into individual antennas.

In still another aspect of the present invention, the method for manufacturing an antenna according to the present invention includes the steps of: i) preparing green sheets consisting of inner and outer ceramic substrates; ii) forming via holes in each of the inner and outer ceramic substrates of the green sheet, and spreading a conductive pattern in each of the via holes; iii) forming primary coil patterns on a surface of each of the inner ceramic substrates by using an antenna pattern forming means; iv) forming secondary coil patterns on a surface of each of the outer ceramic substrates by using an antenna pattern forming means; v) stacking the inner substrates with the primary coils formed thereon between upper and lower sheets of the outer substrates with the secondary coils formed thereon so as to make the via holes of the inner and outer substrates aligned; vi) cutting the stacked structure into individual antennas; and vii) baking the inner and outer substrates of the stacked structure with the primary and secondary coils formed thereon at a predetermined temperature so as to complete the antenna.

In still another aspect of the present invention, the method for manufacturing an antenna according to the present invention includes the steps of: i) preparing a plurality of flexible substrates; ii) forming a diagonal conductive pattern on a first flexible substrate of the plurality of the flexible substrates; iii) forming a plurality of inclined conductive patterns on a surface of a second flexible substrate of the plurality of the flexible substrates at predetermined gaps; iv) winding the first flexible substrate around a cylindrical support; and v) winding the second flexible substrate around the first flexible substrate.

BRIEF DESCRIPTION OF THE DRAWINGS

The above object and other advantages of the present invention will become more apparent by describing in detail the preferred embodiment of the present invention with reference to the attached drawings, in which.

DETAILED DESCRIPTION OF THE PREFERRED EMBODIMENTS

The present invention will be described in detail referring to the attached drawings.

Figure 1:
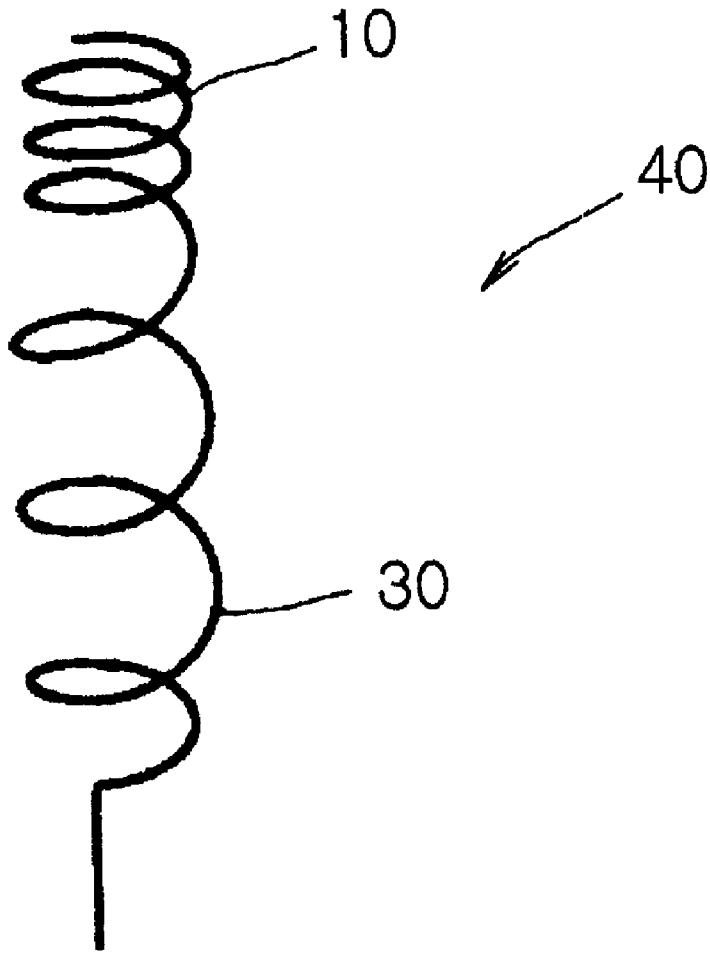
PRIOR ART FIG. 1
FIG. 1 illustrates the constitution and the installed state of the conventional dual band antenna.
Figure 2:
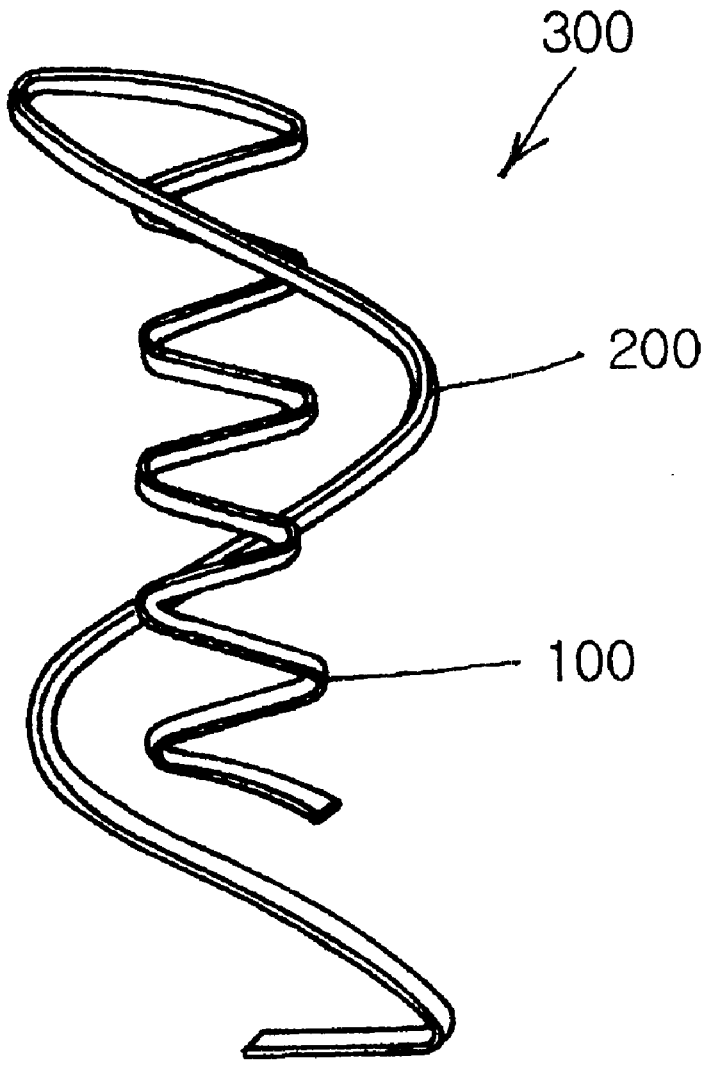
FIG. 2 is a schematic view showing the constitution of the dual band antenna according to the present invention.
Figure 3:
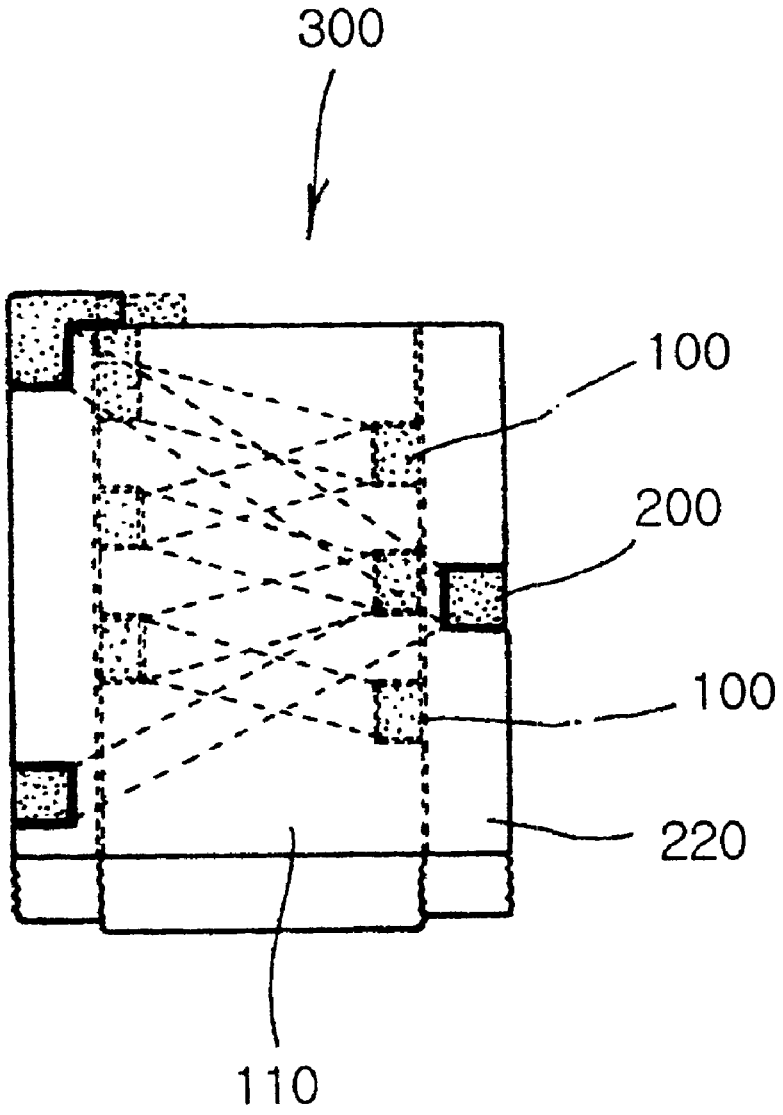
FIG. 3 is a sectional view showing the installed state of the dual band antenna according to the present invention.

FIG. 2 is a schematic view showing the constitution of the dual band antenna according to the present invention. FIG. 3 is a sectional view showing the installed state of the dual band antenna according to the present invention.

The dual band antenna according to the present invention includes: a primary coil 100; and a secondary coil 200 surrounding the primary coil 100, thereby forming an antenna 300.

The primary coil 100 is formed in a spiral shape, and has a predetermined length and predetermined pitches, while the primary coil 100 has also a constant coiling diameter. The center line of the primary coil 100 is disposed substantially on a vertical line.

Figure 4A:
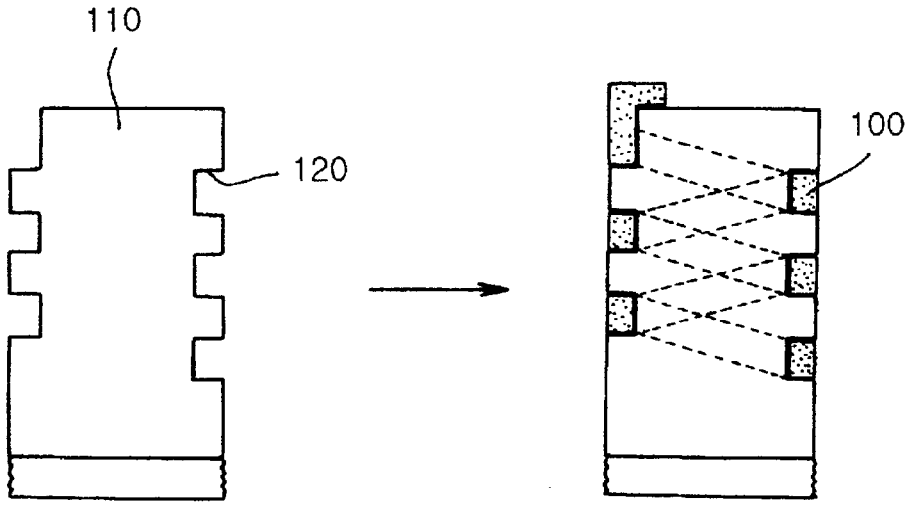
FIGS. 4*a*, 4*b* and 4*c* illustrate the manufacturing process for the dual band antenna according to the present invention.

Meanwhile, as shown in FIG. 4*a*, the primary coil 100 is a spiral coil accommodated within a spiral securing channel 120 which has a predetermined length and predetermined pitches and which is coiled around a cylindrical first body 110. The cylindrical first body 110 is made of a resin, a ceramic or a magnetic material.

Under this condition, the primary coil 100 consists of a wire of a certain diameter which is made of Cu, Ag or a shape memory alloy. Or the primary coil 100 consists of a rolled band. Thus the primary coil 100 is secured into the spiral securing channel 120 of the first body 110, while the upper port ion of the primary coil 100 is made to project from a side of the first body 110.

The secondary coil 200 which is integrally connected to the primary coil 100 is connected to the upper portion of the primary coil 100. The secondary coil 200 has a spiral form, and has a length and pitches larger than those of the primary coil 100.

The secondary coil 200 is made of a material and a diameter same as those of the primary coil, or is made of a rolled band. The vertical axis of the secondary coil 200 lies on the same position as that of the primary coil.

Meanwhile, a second body 220 has a supporting hollow space 210 to accommodate the first body 110 around which the primary coil 100 is wound along the spiral securing channel 120. Another spiral securing channel 230 is formed around the second body 220, and the spiral securing channel 230 has a length and pitches same as those of the secondary coil 200, so that the secondary coil 200 can be inserted into the spiral securing channel 230.

Figure 4B:
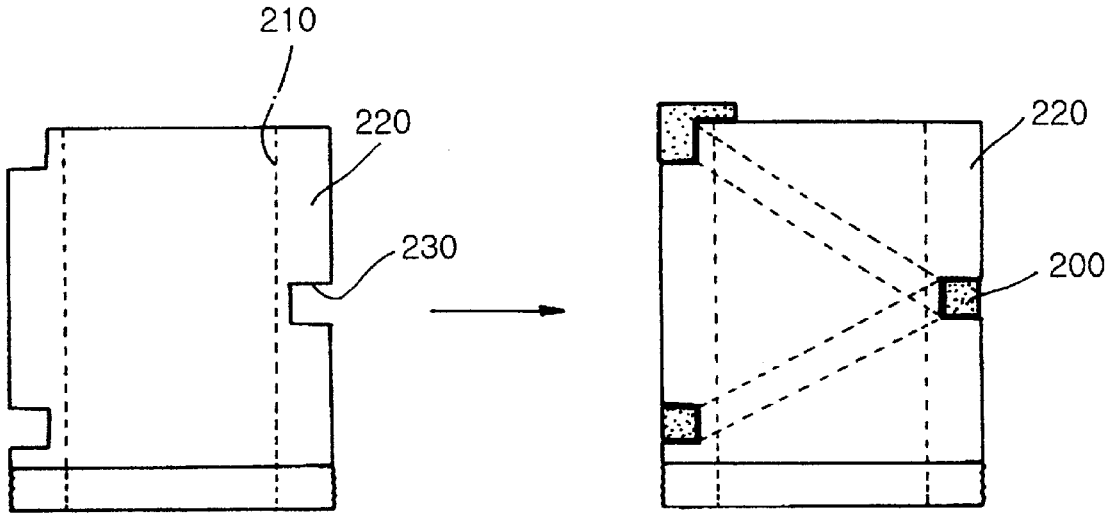

As shown in FIG. 4*b*, the second body 220 around which the secondary coil 200 is wound has a dielectric constant and a permeability same as those of the first body 110, or different from those of the first body 110.

Figure 4C:
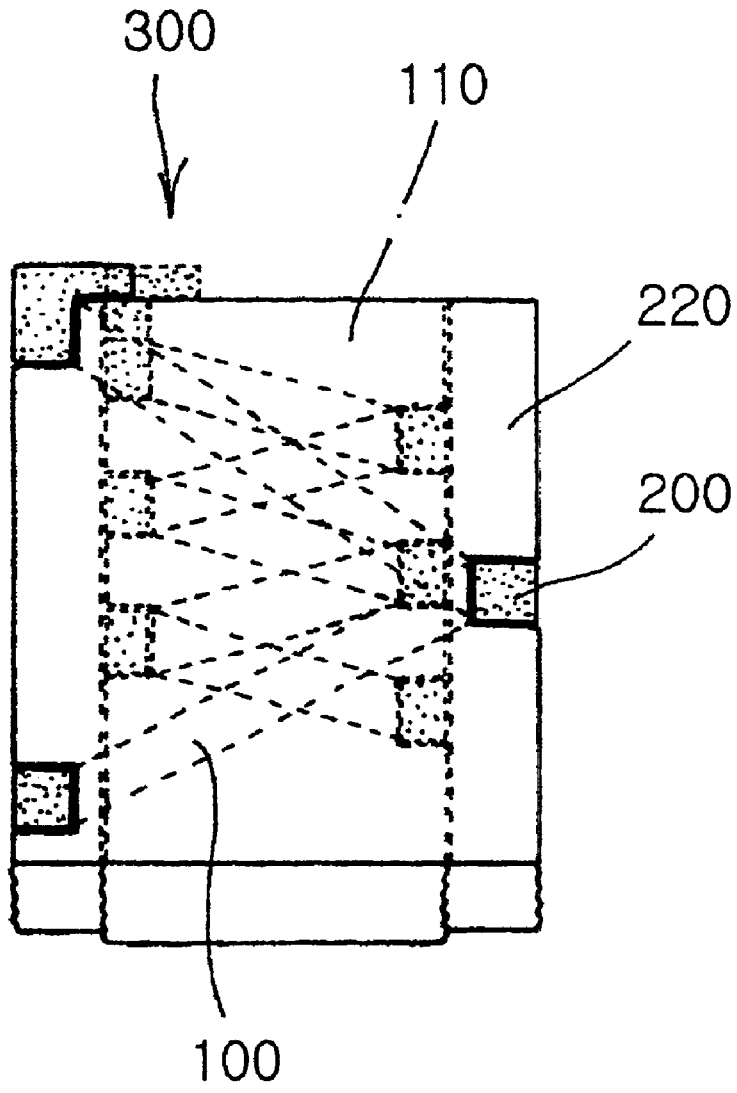

As shown in FIG. 4*c*, the primary coil 100 which is wound around the first body in the spiral form projects to the outside of the first body 110. The projected portion of the first coil 100 is electrically connected to the secondary coil 200 which is wound around the second body 220, with the result that a dual band antenna 300 is formed.

In the primary and secondary coils 100 and 200, the pitches and the angular direction can be adjusted, so that a single band antenna can be formed for receiving signals through a single frequency band.

Thus by the primary and secondary coils 100 and 200, an antenna of a single frequency band is formed. Further, the secondary coil 200 which is wound around the second body 220 in the spiral form makes it possible to form an antenna for receiving signals through another frequency band. Thus a dual band antenna 300 can be formed.

Figure 5:
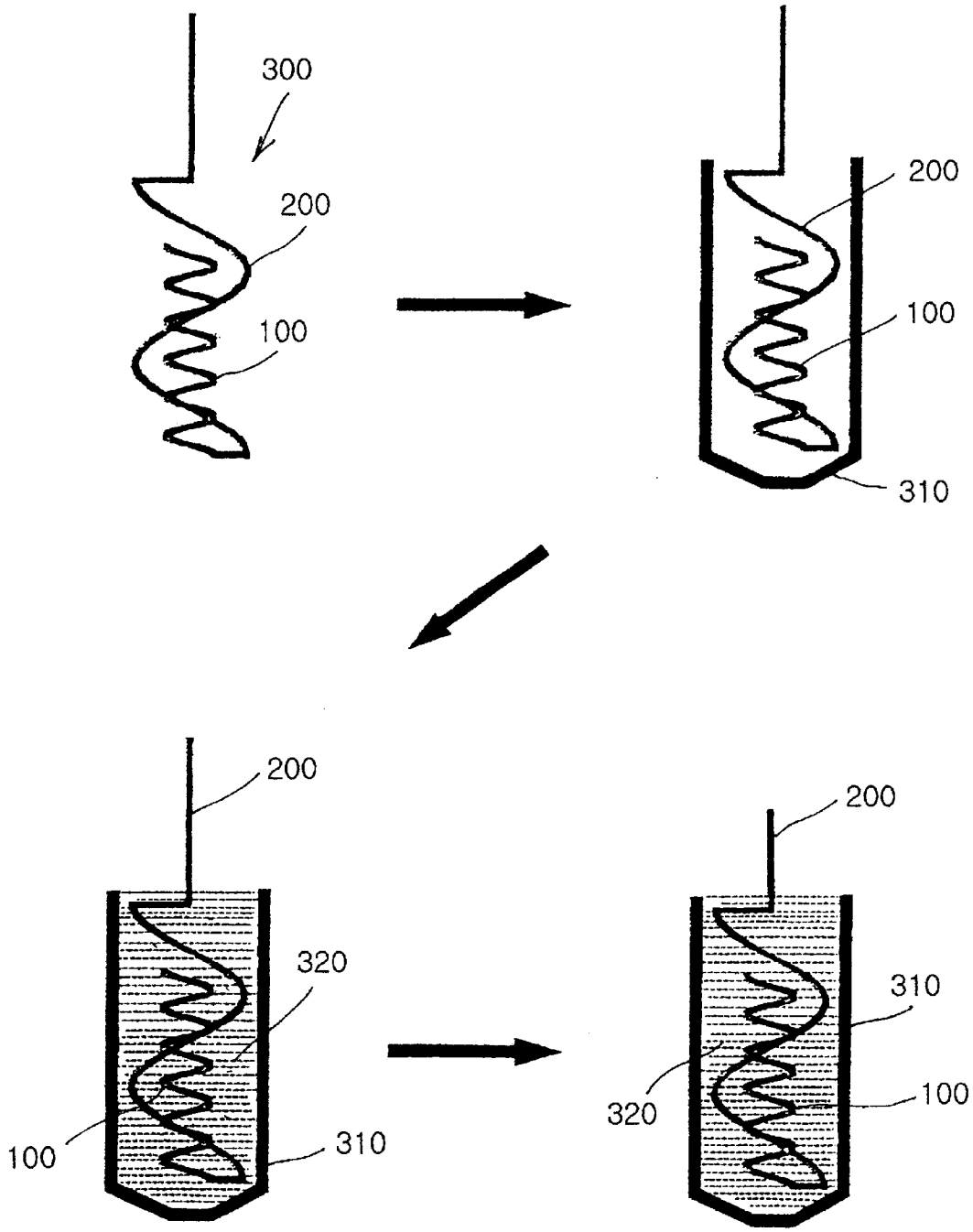
FIG. 5 illustrates the installing procedure for the dual band antenna in a first embodiment of the present invention.

Then as shown in FIG. 5, the antenna 300 which includes the primary and secondary coils 100 and 200 is inserted into a cap housing 310 which is made of a resin.

Then a filling stuff consisting of an epoxy resin or a thermosetting resin is injected into the cap housing 310, so that the dual band antenna can be securely accommodated within the cap housing 310.

Under this condition, the antenna 300 does not require any particular securing means, but is firmly secured by filling the filling stuff 320 into the cap housing 310. Accordingly, the workability and the productivity are improved.

Alternatively, the dual band antenna 300 which includes the primary and secondary coils 100 and 200 can be formed by an insert injection molding by making a plastic composite material or a ceramic dielectric material surround the antenna 300. Here, the ceramic dielectric material has to have a dielectric constant of 2~50.

Figure 9:
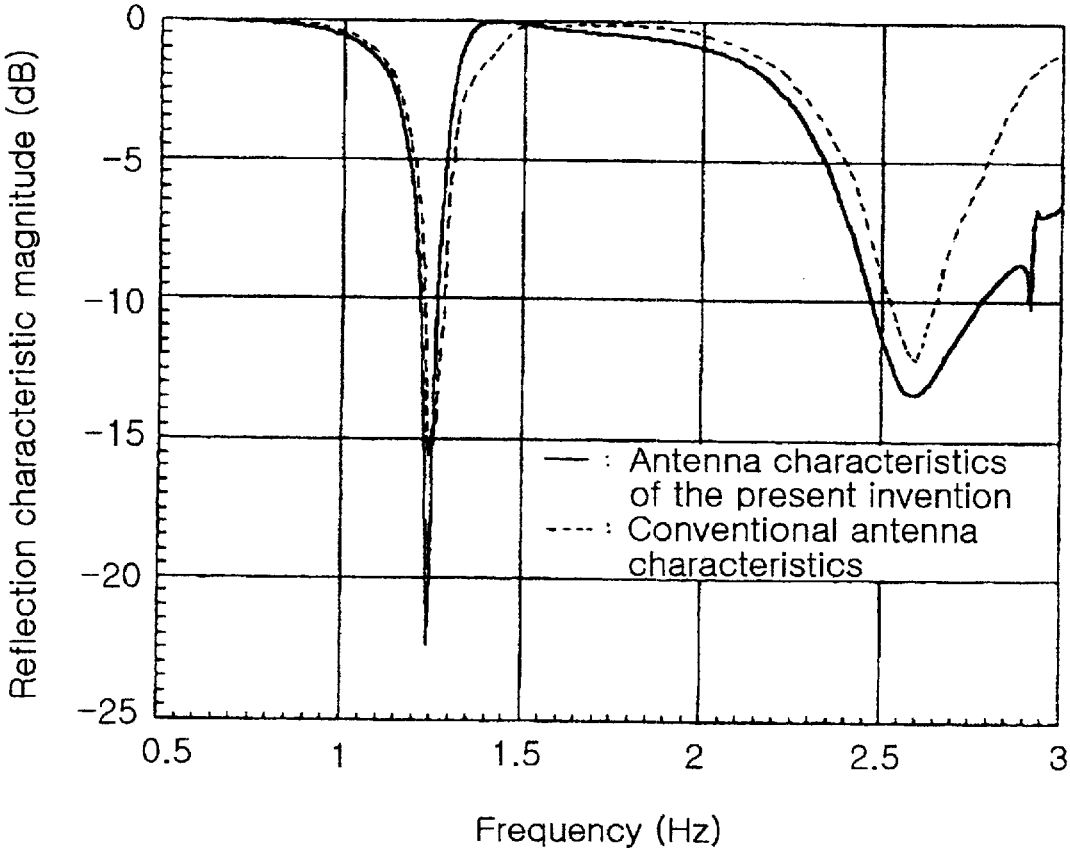
FIG. 9 is a graphical illustration showing the reception band and sensitivity characteristics of the dual band antenna according to the present invention.

As graphically illustrated in FIG. 9, the antenna 300 which includes the primary and secondary coils 100 and 200 shows an expanded frequency reflection band width and a decreased frequency reflection magnitude (dB). Thus the frequency receiving capability becomes superior.

Figure 6:
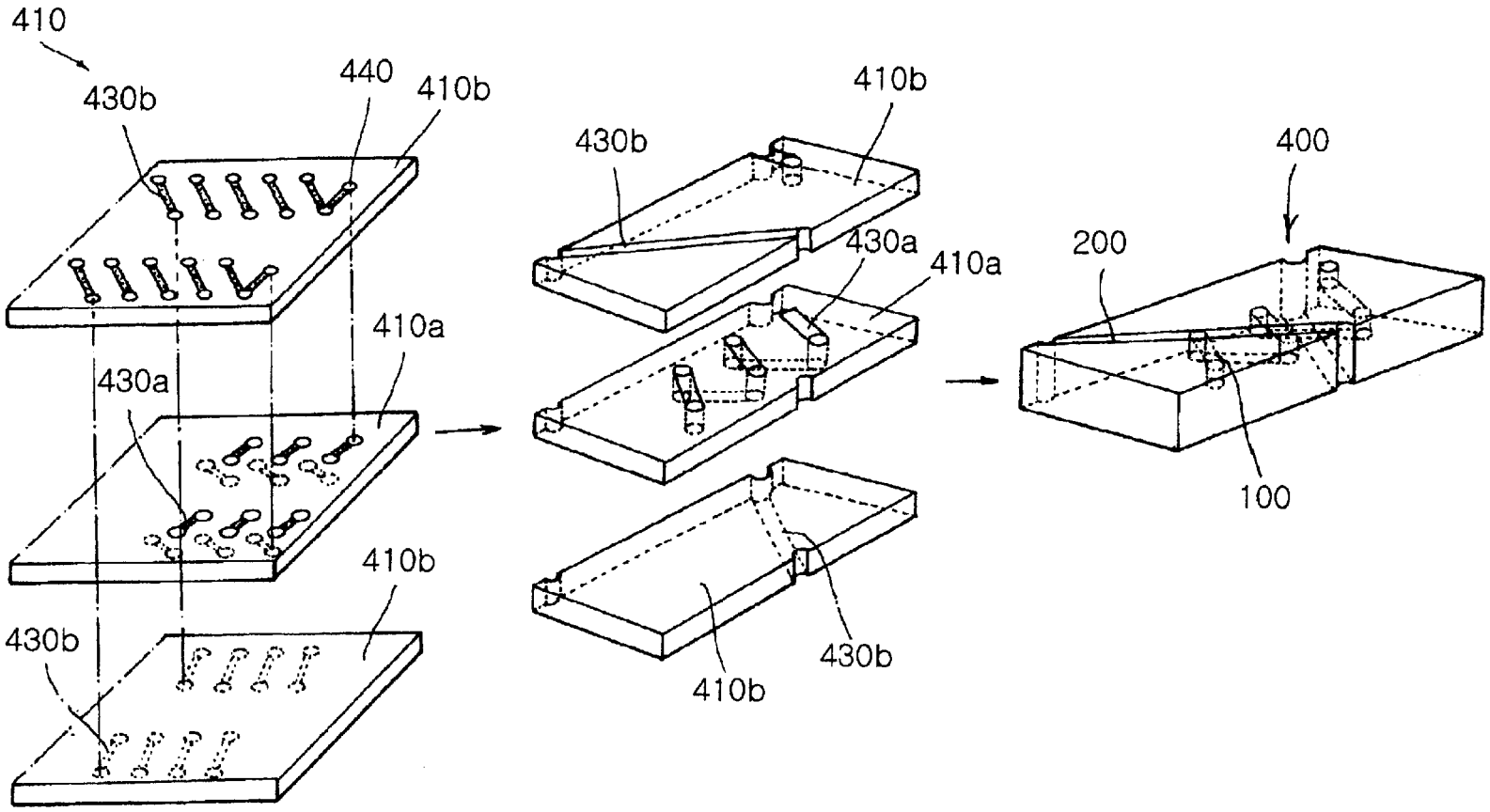
FIG. 6 schematically illustrates the manufacturing process for the dual band antenna in a second embodiment of the present invention.

FIG. 6 schematically illustrates the manufacturing process for the dual band antenna in a second embodiment of the present invention. In order to form two spiral coils having different pitches and diameters, a plurality of via holes 440 are formed at regular intervals on an inner substrate 410*a* and outer substrates 410*b*, thereby forming a ceramic substrate (or a tefrone or resin substrate may be used). On the ceramic substrate, there are formed conductive patterns by using a pattern forming means.

The conductive patterns are formed in the following manner. That is, a coating layer is formed upon the ceramic substrate by using Cu, Ni, Ag or Au and by applying a non-electrolytic coating. Then the coated layer is etched by the photo lithography, so that primary coating patterns 430*a* can be formed on the inner substrate 410*a*, and that secondary coil patterns 410*b* can be formed on the outer substrates 410*b*.

Then the portion of the ceramic substrate where the coil patterns are not formed is cut off, and a cream solder is printed between the inner substrate 410*a* and the outer substrates 410*b* to carry out a soldering. Or the general adhesive and a glass frit is used to bond the inner and outer substrates 410*a* and 410*b* together.

When bonding the inner and outer substrates 410*a* and 410*b* together, the primary coil patterns 430*a* which are formed on the upper and lower faces of the inner substrate 410*a* are connected together through the via holes 440 so as to form a primary coil 100. Further, the secondary coil patterns 430*b* of the outer substrates 410*b* which are respectively bonded to the upper and lower faces of the inner substrate 410*a* are connected together respectively through the via holes 440 so as to form a secondary coil 200. Thus a dual band antenna 400 is formed.

Figure 7:
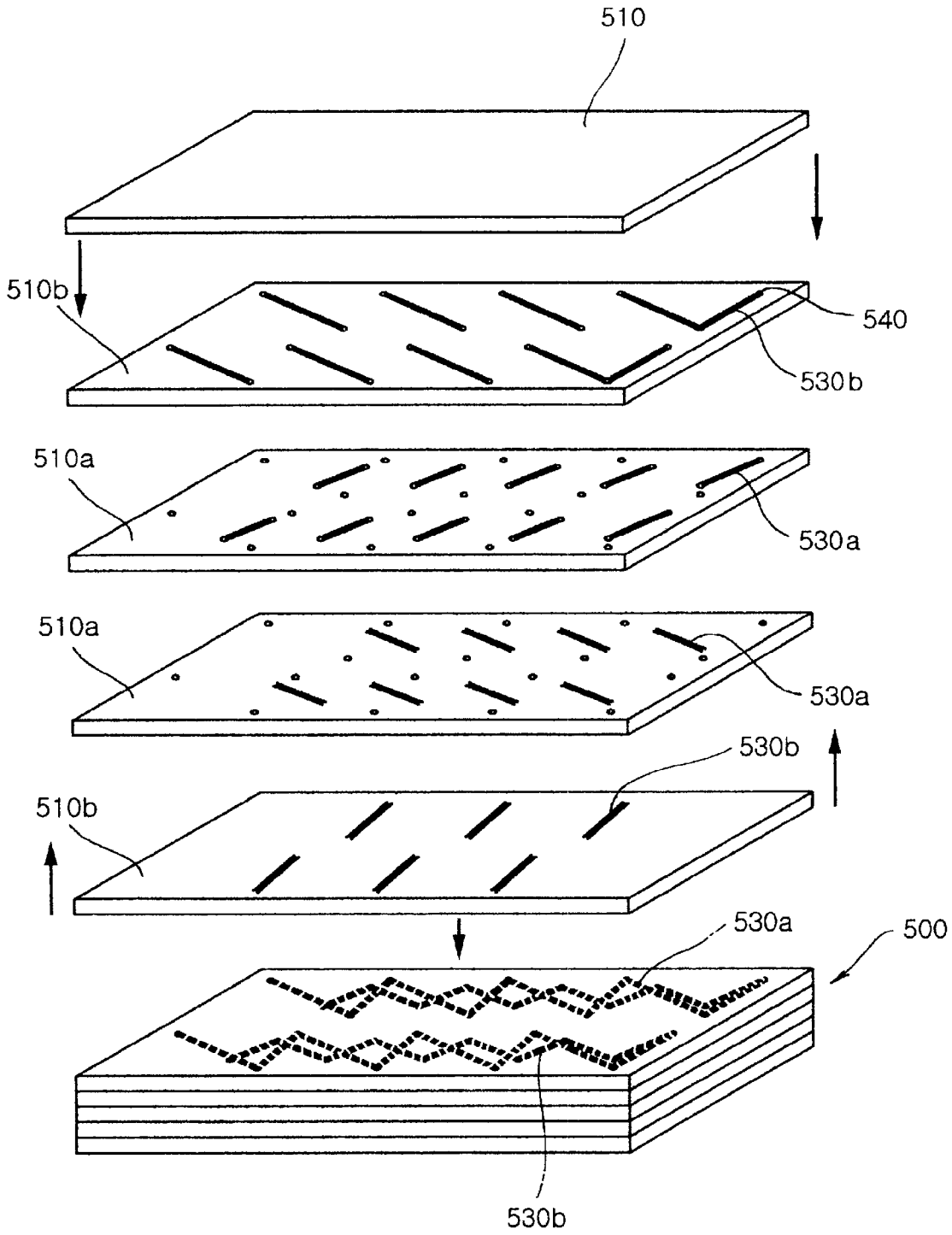
FIG. 7 schematically illustrates the manufacturing process for the dual band antenna in a third embodiment of the present invention.

FIG. 7 schematically illustrates the manufacturing process for the dual band antenna in a third embodiment of the present invention.

A plurality of via holes 540 are formed in each of green sheets 510 which are formed by using a ceramic paste, so that coil shaving different pitches and diameters can be formed on each of the green sheets 510.

Primary coil patterns 530*a* which are printed on the inner substrates 510*a* are connected through the via holes 540 to secondary coil patterns 530*b* of outer substrates 510*b*, thereby forming a spiral antenna 500.

Under this condition, the pattern forming means which forms the primary and secondary coil patterns 530*a* and 530*b* operates as follows. That is, a conductive paste made of Cu, Ni, Ag or Au is printed to form the patterns, and thus, when stacking the green sheets, spiral coils are formed by being electrically connected together respectively through the via holes 540.

After stacking the inner substrates 510*a* and the outer substrates 510*b* with the primary coil patterns 530*a* and the secondary coil patterns 530*b* formed thereon, the substrates are pressed together at a pressure of 80~120 $Kg/cm^2$ so as to form a final structure. This structure is cut into individual antennas, and they are baked at a temperature of 800~1000° C., thereby forming a dual band antenna 500.

If the antennas of the second and third embodiments which are formed by stacking the ceramic substrates or the green sheets are applied in the hand phone or the like, the antennas do not protrude to the outside of the apparatus, and therefore, the apparatus can be miniaturized.

Figure 8:
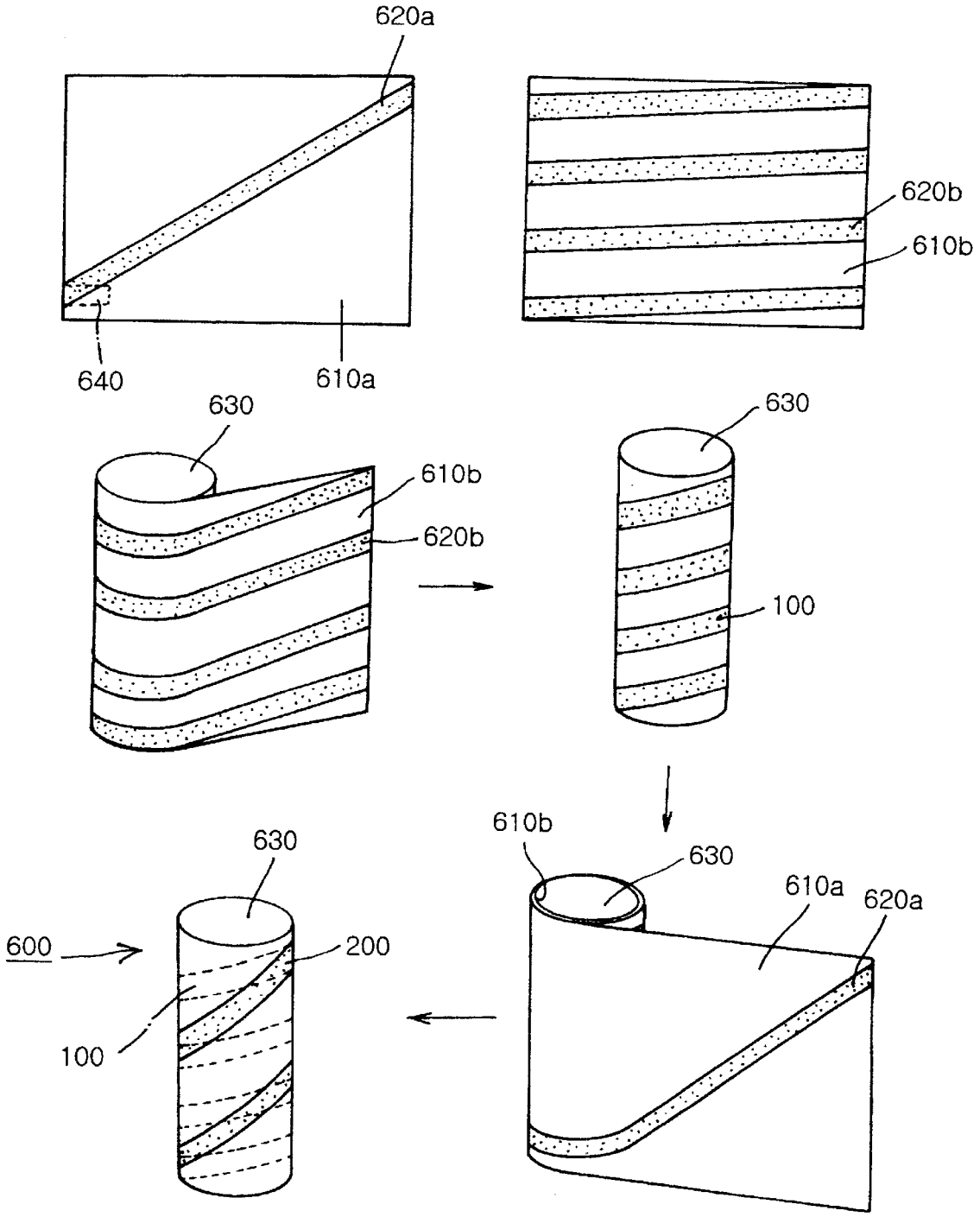
FIG. 8 schematically illustrates the manufacturing process for the dual band antenna in a fourth embodiment of the present invention.

FIG. 8 schematically illustrates the manufacturing process for the dual band antenna in a fourth embodiment of the present invention.

As shown in this drawing, a first conductive pattern 620*a* is printed on a first flexible substrate in the diagonal direction, while a grounding pattern 640 is printed on the other face of the substrate in such a manner as to be connected to the first conductive pattern 620*a*.

Then a plurality of second conductive patterns 620*b* are printed on a second flexible substrate 610*b* at a certain inclination angle. Then the second flexible substrate 610*a* is wound around a cylindrical support 630 which is made of a resin, a ceramic or a magnetic material.

The second conductive patterns 620*b* of the second flexible substrate 610*b* which has been wound around the cylindrical support 630 form a primary coil 100. Then the first flexible substrate 610*a* is wound around the second flexible substrate 610*b*, and thus, the first conductive pattern 620*a* becomes a secondary coil 200.

The grounding pattern 640 which has been printed on the other face of the first flexible substrate 610*a* is connected to the second conductive patterns 620*b* of the second flexible substrate 610*b*, and therefore, the two sets of the conductive patterns 620*a* and 620*b* are electrically connected together, so as to form a dual band antenna 600.

Besides the connections between the two sets of conductive patterns 620*a* and 620*b* of the first and second flexible substrates 610*a* and 610*b* by utilizing the grounding pattern 640, the connections can also be carried out by soldering.

Thus the antenna 600 can be embodied in a simple manner by winding the first and second flexible substrates around the cylindrical support 630. The cylindrical support 630 may have a minimum diameter, and therefore, the miniaturization of the antenna becomes possible as well as improving the reception sensitivity.

According to the present invention as described above, the dual band antenna which receives signals through a plurality of frequency bands is improved in its reception sensitivity, is miniaturized, and is prevented from being deformed or damaged upon receiving an external impact. Further, the reception band width can be expanded.

Further, the desired dielectric constant can be obtained by arbitrarily selecting the dielectric material, and therefore, the design limitation can be minimize. Further, the conductive lines can be accurately provided, and therefore, the defect rate can be minimized.

In the above, the present invention was described based on the specific preferred embodiments and the attached drawings, but it should be apparent to those ordinarily skilled in the that various changes and modifications can be added without departing from the spirit and scope of the present invention which will be defined in the appended claims.

What is claimed is:

1. An antenna, comprising:

a spiral primary coil having certain pitches; and a spiral secondary coil disposed outside the primary coil and having pitches larger than those of the primary coil, the secondary coil having one end connected to one end of the primary coil, extending toward the other end of the primary coil, and ending at the other end of the secondary coil which is adapted to be a feeding point so that the entire primary and secondary coils are effective for operation in a frequency band, and the secondary coil is effective for operation in another, different frequency band.

2. The antenna as claimed in claim 1, further comprising:

a first cylindrical body with a spiral securing channel formed therein, for accommodating the primary coil; and a second cylindrical body with another spiral securing channel formed therein, for accommodating the secondary coil, the first cylindrical body being inserted into the second cylindrical body.

3. The antenna as claimed in claim 1, further comprising a cap housing receiving the primary coil and the secondary coil therein and a filling stuff of an insulating resin filled in the cap housing so as to insulate the primary and secondary coils from each other.

4. The antenna as claimed in claim 3, wherein the filling stuff for insulating the primary and secondary coils from each other is one selected from the group consisting of an epoxy resin and a thermosetting resin.

5. The antenna as claimed in claim 3, wherein the filling stuff for insulating the primary and secondary coils from each other is a ceramic/plastic composite material.

6. The antenna as claimed in claim 3, wherein the filling stuff for insulating the primary and secondary coils from each other is a polymer composite material.

7. The antenna as claimed in claim 1, wherein the primary coil is wound in a direction opposite to that of the secondary coil.

8. The antenna as claimed in claim 1, wherein the primary coil is wound in a direction same as that of the secondary coil.

9. The antenna as claimed in claim 1, wherein the spiral primary and secondary coils share a substantially vertical axis and are made form materials having different cross sectional dimension.

10. The antenna as claimed in claim 1, wherein pitches and coiling directions of the primary and secondary coils are adjustable to be tuned to said frequency bands.

11. The antenna of claim 1, wherein the primary and secondary coils are connected in series.

12. A method for manufacturing an antenna, comprising the steps of:

forming a first cylindrical body;

forming a first securing spiral channel around the first cylindrical body starting from an end of the first cylindrical body to a certain part of the first cylindrical body and having a predetermined length and predetermined pitches;

installing a primary coil in the first securing spiral channel;

forming a second cylindrical body having an inside diameter same as or larger than an outside diameter of the first cylindrical body, so as to receive the first cylindrical body;

forming a second securing spiral channel around the second cylindrical body starting from an end of the second cylindrical body to a certain part of the second cylindrical body and having a predetermined length and predetermined pitches;

installing a secondary coil in the second securing spiral channel; and inserting the first cylindrical body into the second cylindrical body, and electrically connecting a portion of the exposed secondary coil of the second cylindrical body to a portion of the exposed primary coil of the first cylindrical body.

13. The method as claimed in claim 12, wherein the primary and secondary coils are made of one selected from the group consisting of Cu, Ag and a shape memory alloy.

14. A method for manufacturing an antenna, comprising the steps of:

i) preparing an inner ceramic substrate and outer ceramic substrates;

ii) forming a plurality of via holes in each of the inner and outer ceramic substrates, and filling a conductive paste in the via holes;

iii) forming primary coil patterns on opposite surfaces of the inner ceramic substrate so that the primary coil patterns are connected together in spiral form through a set of the via holes of the inner substrate so as to form a primary coil iv) forming secondary coil patterns on a surface of each of the outer ceramic substrates;

v) bonding the inner and outer substrates together with the inner substrate having the primary coil disposed between the outer substrates so that the secondary coil patterns are connected together in spiral form through another set of the via holes of the inner substrate and the via holes of the outer substrates so as to form a secondary coil.

15. The method as claimed in claim 14, wherein step iii) comprises the sub-steps of:

forming coated layers by non-elcctrolytically coating one selected from the group consisting of Cu, Ni, Ag and Au on the inner ceramic substrate; and etching the coated layers by photo lithography to form the primary coil patterns connected to said set of via holes formed in the inner substrate.

16. The method as claimed in claim 14, wherein step iv) comprises the sub-steps of:

forming coated layers by non-electrolytically coating one selected from the group consisting of Cu, Ni, Ag and Au on the outer ceramic substrates; and etching the coated layers by photo lithography to form the secondary coil patterns connected to said other set of via holes formed in the inner substrate and the via holes formed in the outer substrates.

17. The method as claimed in claim 14, wherein in step v), the bonding is carried out by using at least one of a cream solder, an adhesive and a glass frit.

18. A method for manufacturing an antenna, comprising the steps of:

i) preparing green sheets;

ii) forming a plurality of via holes in each of the green sheets, and filling a conductive material in each of the via holes;

iii) forming primary coil patterns on a surface of each of at least two inner sheets among said green sheets;

iv) forming secondary coil patterns on a surface of each of at least two outer sheets among said green sheets;

v) stacking the inner sheets between the outer sheets so as to align the respective via holes of the inner and outer sheets; and vi) baking the sheets of the stacked structure with the primary and secondary coil patterns formed thereon at a predetermined temperature so as to complete the antenna.

19. The method as claimed in claim 18, wherein in step iii), a conductive paste made of one selected from the group consisting of Cu, Ni, Ag or Au is printed or deposited on the inner sheets so as to form the primary coil patterns connected to a set of the via holes of the inner sheets.

20. The method as claimed in claim 18, wherein in step iv), a conductive paste made of one selected from the group consisting of Cu, Ni, Ag or Au is printed or deposited on the outer sheets so as to form the secondary coil patterns connected to the via holes of the outer sheets.

21. The method as claimed in claim 18, wherein in step vi), the stacked sheets are pressed together at a pressure of from about 80 to about 120 Kg/cm2, and said baking is carried out at a temperature of from about 800 to about 1000° C.

22. A method for manufacturing an antenna, comprising the steps of:

i) preparing first and second flexible substrates;

ii) forming a first conductive pattern on a major face of the first flexible substrate in a diagonal direction thereof;

iii) forming a plurality of second conductive patterns on the second flexible substrate so that the second conductive patterns are inclined and spaced by predetermined gaps;

iv) winding the second flexible substrate around a support; and v) winding the first flexible substrate around the support and overlying the second flexible substrate.

23. The method as claimed in claim 22, further comprising a grounding pattern formed on the other major face of the first flexible substrate so as to electrically connect the first conductive pattern of the first flexible substrate to the second conductive pattern of the second flexible substrate.

24. The method as claimed in claim 22, wherein the support is made cylindrical from one selected from the group consisting of a resin, a ceramic and a magnetic material.

* * * * *